US006089826A

United States Patent [19]

Tomita et al.

[11] Patent Number: 6,089,826

[45] Date of Patent: Jul. 18, 2000

[54] TURBULATOR FOR GAS TURBINE COOLING BLADES

[75] Inventors: Yasuoki Tomita; Sunao Aoki; Hiroki Fukuno; Kiyoshi Suenaga, all of Takasago, Japan

[73] Assignee: Mitsubishi Heavy Industries, Ltd., Tokyo, Japan

[21] Appl. No.: 09/180,469

[22] PCT Filed: Mar. 31, 1998

[86] PCT No.: PCT/JP98/01482

§ 371 Date: Nov. 9, 1998

§ 102(e) Date: Nov. 9, 1998

[87] PCT Pub. No.: WO98/44241

PCT Pub. Date: Oct. 8, 1998

[30] Foreign Application Priority Data

Apr. 2, 1997 [JP] Japan ..... 9-083820

[51] Int. Cl.[7] ..... F01D 5/18

[52] U.S. Cl. ..... 416/96 R; 416/97 R; 416/96 A; 415/115

[58] Field of Search ..... 415/115, 116; 416/96 R, 97 R, 96 A

[56] References Cited

U.S. PATENT DOCUMENTS

| | | |
|---|---|---|
| 4,515,526 | 5/1985 | Levengood . |
| 4,786,233 | 11/1988 | Shizuya et al. . |
| 5,232,343 | 8/1993 | Butts . |
| 5,472,316 | 12/1995 | Taslim et al. . |

FOREIGN PATENT DOCUMENTS

| | | |
|---|---|---|
| 59-122705 | 7/1984 | Japan . |
| 61-001804 | 1/1986 | Japan . |
| 62-085102 | 4/1987 | Japan . |
| 62-85102 | 4/1987 | Japan . |
| 62-271902 | 11/1987 | Japan . |
| 6-101405 | 4/1994 | Japan . |
| 8-170501 | 7/1996 | Japan . |
| 1033759 | 6/1966 | United Kingdom . |

*Primary Examiner*—Edward K. Look
*Assistant Examiner*—Liam McDowell
*Attorney, Agent, or Firm*—Wenderoth, Lind & Ponack, L.L.P.

[57] ABSTRACT

A gas turbine cooled blade has leading edge turbulators. A rounded tip portion of the leading edge portion cooling passage (3) is approximated by a triangular cooling passage (1) having orthogonal turbulators (11, 12) and a smoothly curved rear portion thereof of the leading edge portion cooling passage (3) is approximated by a square cooling passage 2 having oblique turbulators (13, 14).

3 Claims, 7 Drawing Sheets

61
62
63
71
α
β
BEST
WORST

TURBULATOR FOR GAS TURBINE COOLING BLADES

BACKGROUND OF THE INVENTION

1. Field of the Invention

The present invention relates to gas turbine cooled blade turbulators, specifically to turbulators applied to a blade leading edge portion of a gas turbine cooled blade for enhancing heat transfer performance.

2. Description of the Prior Art

FIG. 6, being a longitudinal cross sectional view of a prior art gas turbine moving blade, shows an arrangement of turbulators in cooling air passages thereof and FIG. 7 is a transverse cross sectional view of the gas turbine moving blade of FIG. 6. In these figures, numeral 30 designates a moving blade and cooling passages 31A, 31B, 31C, 31D and 31E are provided therein so that cooling air 33 is supplied into the cooling passages 31A, 31B and 31E, respectively. The cooling air 33 which has entered the cooling passage 31A is discharged from a leading edge portion to effect a shower head cooling 51 as shown in FIG. 7. The cooling air 33 which has entered the cooling passage 31B flows through the cooling passage 31C and further through the cooling passage 31D to be discharged from a blade surface to effect a film cooling 52 as shown in FIG. 7. Also, the cooling air 33 which has entered the cooling passage 31E on a trailing edge side is discharged through a trailing edge to effect a pin fin cooling 53 as shown in FIG. 7.

In each of the cooling passages 31A to 31E, in order to make the cooling air 33 convection-activated and enhance a heat transfer ability, there are provided a multiplicity of oblique turbulators 32, wherein the turbulators 32 are of same shapes arranged obliquely with respect to each of the cooling passages, as shown in FIG. 6.

Also, in FIG. 8 showing a longitudinal cross sectional view of another example of a prior art gas turbine moving blade, numeral 40 designates a moving blade and cooling passages 41A, 41B, 41C, 41D, 41E, 41F and 41G are provided therein so that cooling air 43 is supplied into the cooling passages 41A, 41D and 41E, respectively. The cooling air 43 which has entered the cooling passage 41A is discharged from a leading edge portion to effect a shower head cooling, same as mentioned above. The cooling air 43 which has entered the cooling passage 41D flows through the cooling passages 41C and 41B and the cooling air 43 which has entered the cooling passage 41E flows through the cooling passages 41F and 41G both to be discharged from a blade surface to effect a film cooling. Also, the cooling air 43 which has flown through the cooling passages 41F and 41G is discharged through a trailing edge to effect a pin fin cooling.

In each of the cooling passages 41A to 41G, in order to make the cooling air 43 convection-activated and enhance a heat transfer ability, there are provided a multiplicity of orthogonal turbulators 42, wherein the turbulators 42 are of same shapes arranged orthogonally with respect to each of the cooling passages, as shown in FIG. 8.

As mentioned above, the prior art turbulators of gas turbine cooled blades are made in one kind either of oblique turbulators or of orthogonal turbulators and it is said generally that the oblique turbulators are more excellent in the heat transfer characteristics in the case where the cooling passages have a square cross sectional shape.

Also, of recent papers on the turbulators, one titled, "Heat transfer performance in triangular channels", Zhang et al., 1994, for example, shows a comparison example as shown in FIG. 5, with detailed description made therein being omitted here.

In FIG. 5, cases (a) to (e) are examples where there are provided ribs in the triangular channels, respectively. Case (a) is an example where ribs 61, 62 and 63 are provided separately from each other to inner walls of the triangular channel respectively with angle $\alpha=90°$, $\alpha$ being an angle relative to air flow direction. Case (b) is an example where a rib 71 is provided along an entire circumference of the inner wall of the triangular channel likewise with the angle $\alpha=90°$. Case (c) is an example where the ribs 61, 62 and 63 are provided separately like the case (a) but obliquely with an angle $\beta<90°$, $\beta$ being an angle relative to air flow direction. Case (d) is an example where the rib 71 is provided along the entire circumference of the inner wall like the case (b) but obliquely with the angle $\beta<90°$ and Case (e) is an example where the ribs 61 and 62 are provided to two sides of the inner wall of the triangular channel obliquely with the angle $\beta<90°$.

In the mentioned cases (a) to (e), if they are to be shown in the order of good heat transfer coefficient, the order is (a), (b), (c), (d) and (e). Thus, as to the ribs provided on the inner wall of the triangular channel, the case where the ribs 61, 62 and 63 are provided separately on the inner wall with the angle $\alpha=90°$, as the case (a), is most excellent in the heat transfer coefficient.

SUMMARY OF THE INVENTION

In the prior art turbulators of the gas turbine cooled blades as mentioned above, the turbulators are made either as oblique ones or as orthogonal ones. On the other hand, there is needed a large amount of cooling air for cooling of the blades and moreover the cooling air which has been so used for the cooling of the blades is discharged into a gas passage. Hence, it is necessary that the turbulators are arranged in a cooling passage so as to provide excellent heat transfer characteristics to thereby enhance a cooling efficiency of the cooling air.

The leading edge of the blade is a portion which is most largely influenced by a high temperature combustion gas flow and while cooling of the leading edge portion is required to be done efficiently, it is the present situation that the turbulators provided in the cooling passage of the leading edge portion are only either oblique ones or orthogonal ones. As for the triangular cross sectional passage in which ribs are provided as mentioned above, it is known that the case where the three ribs 61, 62 and 63 are provided separately with the angle $\alpha=90°$, that is, orthogonally to air flow, as the case (a) in FIG. 5, is most excellent in terms of the heat transfer.

Thus, putting eyes on turbulators provided in the cooling passage of the leading edge portion of gas turbine cooled blade, it is an object of the present invention to improve an arrangement of turbulators so as to obtain a better heat transfer.

In order to attain said object, the present invention provides the following arrangement.

Gas turbine cooled blade turbulators provided in a leading edge portion cooling passage of a gas turbine cooled blade. Orthogonal turbulators are provided on a rounded inner wall portion of a transverse cross sectional tip portion of the leading edge portion cooling passage. And oblique turbulators are provided on a smoothly curved inner wall portion in the rear thereof.

In the present invention, the rounded inner wall portion of the transverse cross sectional tip portion of the leading edge portion cooling passage is approximated by a triangle shape in which the orthogonal turbulators are excellent in the heat transfer characteristics. Hence, the orthogonal turbulators are arranged in this rounded inner wall portion. The smoothly curved inner wall portion in the rear of the rounded inner wall portion is approximated by a square shape in which the oblique turbulators are known to be excellent with respect to heat transfer characteristics. Hence, the oblique turbulators are arranged in this smoothly curved portion. By the present invention in which the turbulators are so arranged, the heat transfer characteristics of the leading edge portion cooling passage can be enhanced as compared with the prior art arrangement in which the turbulators are either orthogonal or oblique only.

DESCRIPTION OF THE PREFERRED EMBODIMENTS

Figures 1A, 1B, 1C:
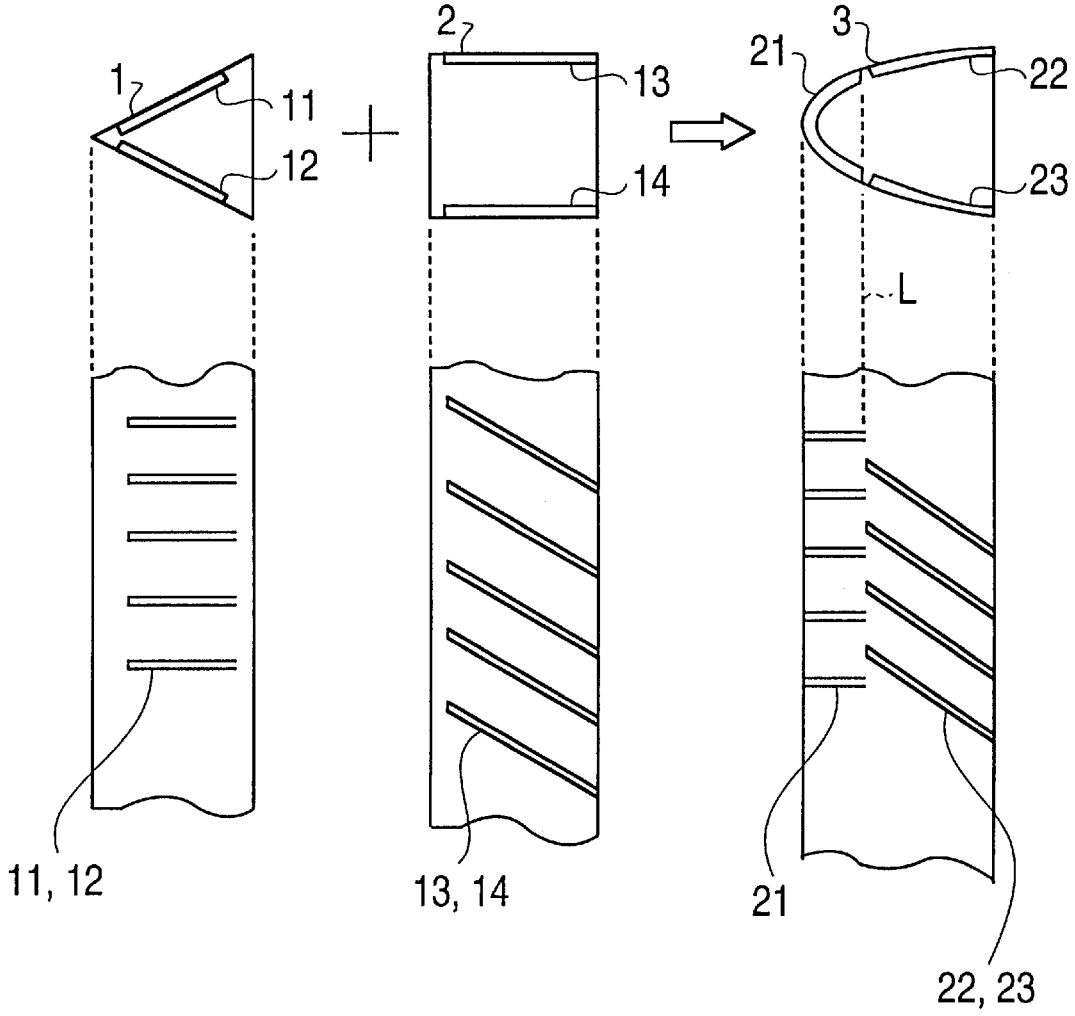
FIGS. 1(*a*) to 1(*c*) are a schematic views of turbulators arranged in accordance with an embodiment of the present invention. The turbulators are provided in a leading edge portion cooling passage of a gas turbine cooled blade, and shows a transverse cross section of the cooling passage on one hand and a longitudinal inner wall side face of same on the other hand, wherein FIG. 1(*a*) is a view in which a portion of the cooling passage is approximated by a triangular passage, FIG. 1(*b*) is a view in which another portion of the cooling passage is approximated by a square passage and FIG. 1(*c*) is a view in which both portions are combined so as to form the leading edge portion cooling passage.
Figure 2:
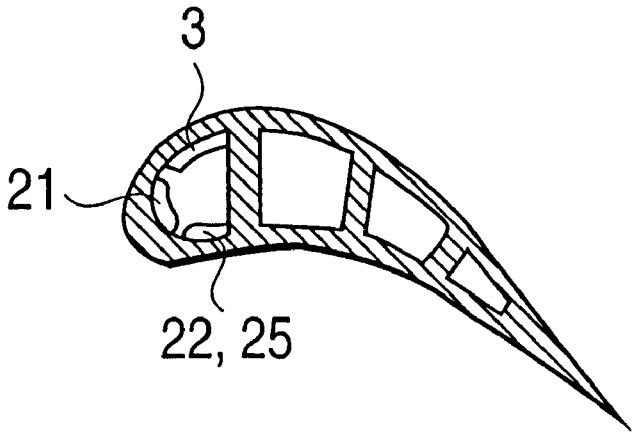
FIG. 2 is a transverse cross sectional view of the gas turbine cooled blade provided with the turbulators of the embodiment of FIG. 1.

Herebelow, embodiments according to the present invention will be described with reference to the figures. FIG. 1 shows a transverse cross section and a longitudinal inner wall side face of a leading edge portion cooling passage of a gas turbine cooled blade which is provided with turbulators of one embodiment according to the present invention. The leading edge portion cooling passage is sectioned into two parts so as to be approximated by a triangular passage and a square passage, respectively. Turbulators are arranged in the passages so as to obtain excellent heat transfer characteristics, respectively, which results in obtaining an excellent turbulator arrangement of a leading edge portion in a combination of to two passages. FIG. 2 is a transverse cross sectional view of the gas turbine cooled blade provided with the turbulators of FIG. 1.

FIG. 1(*a*) shows a rounded inner wall portion, with turbulators provided thereto, of a transverse cross section of the leading edge portion cooling passage which is approximated by a triangular passage. FIG. 1(*b*) shows a smoothly curved inner wall portion, with turbulators provided thereto, in the rear thereof of the leading edge portion cooling passage which is approximated by a square passage and FIG. 1(*c*) shows a transverse cross section of the leading edge portion cooling passage formed in a combination of the cooling passages of FIGS. l(*a*) and (*b*).

Figures 5A, 5B, 5C, 5D, 5E:
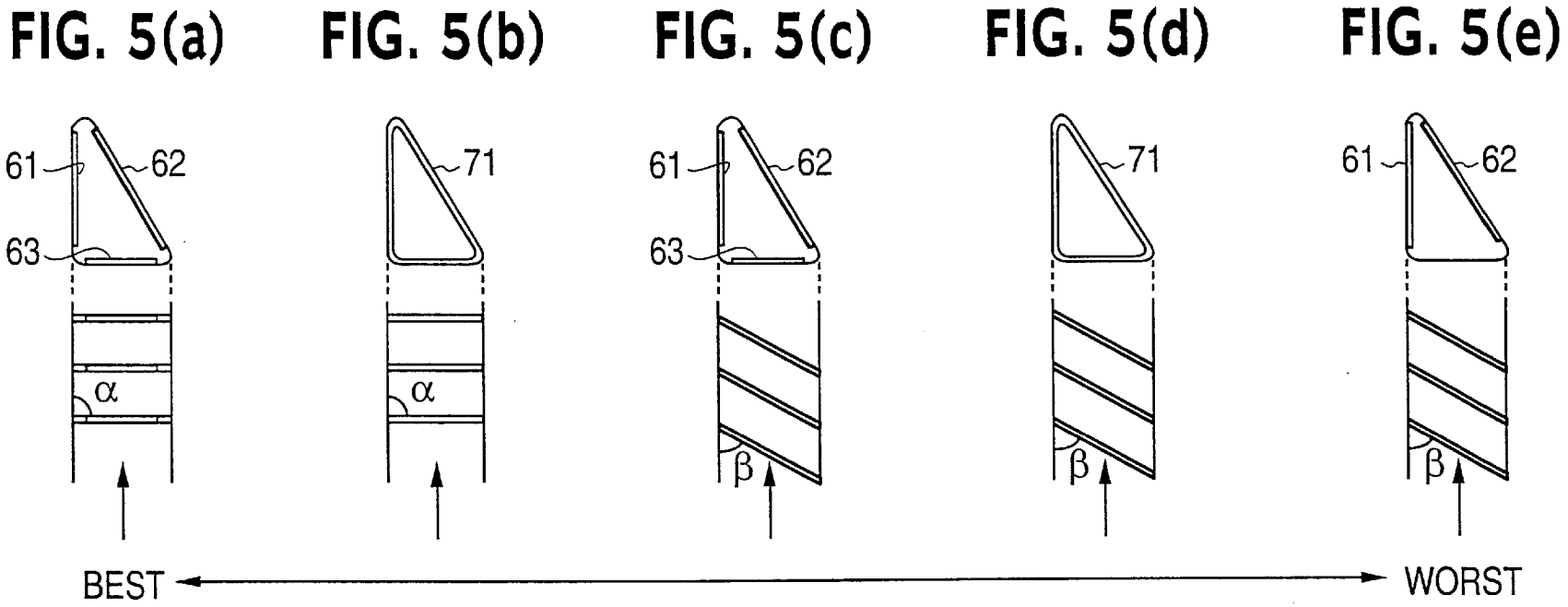
FIGS. 5(*a*) to 5(*c*) are views showing cases where ribs are provided in triangular channels, respectively, wherein cases (a), (b), (c), (d) and (e) show excellence in heat transfer characteristics in order.
Figure 6:
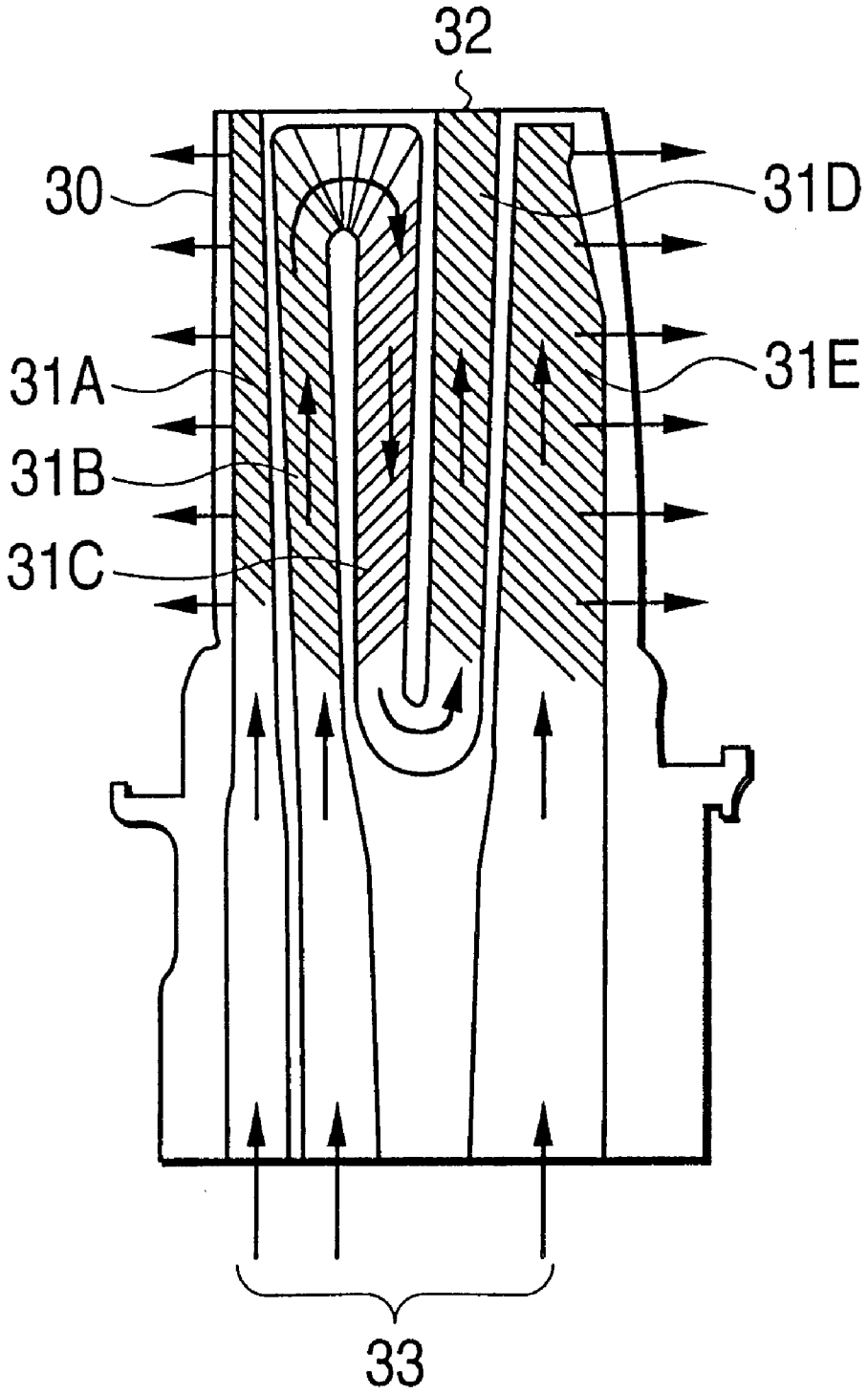
FIG. 6 (PRIOR ART)
FIG. 6 is a longitudinal cross sectional view of a prior art gas turbine moving blade and shows oblique turbulators provided therein.
Figure 7:
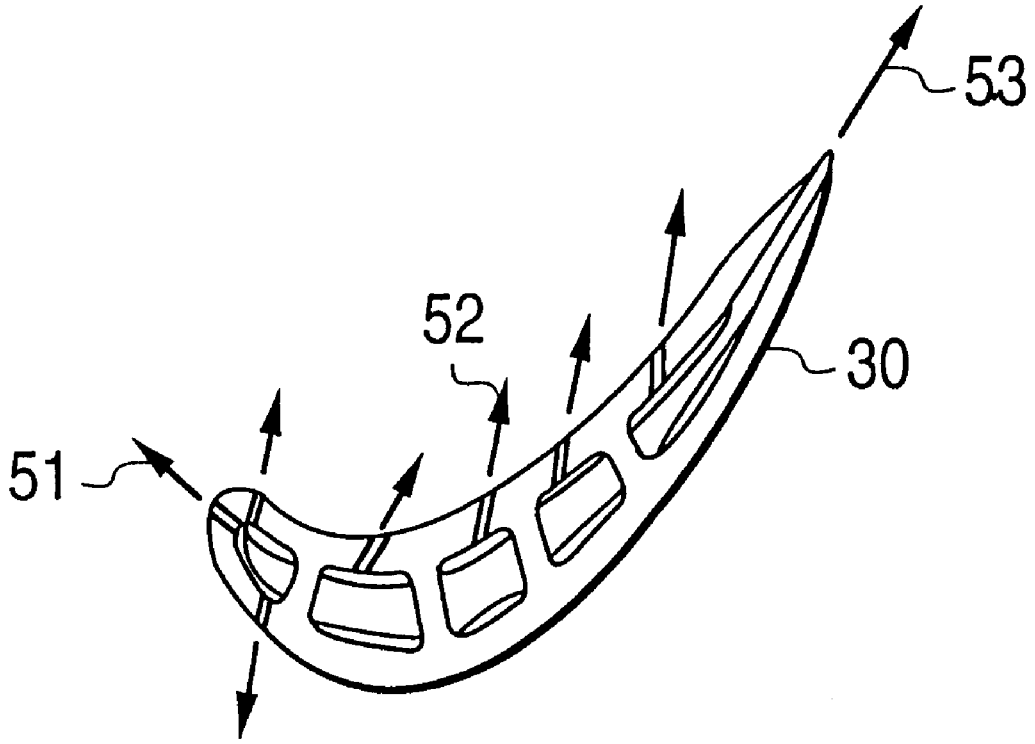
FIG. 7 (PRIOR ART)
FIG. 7 is a transverse cross sectional view of the moving blade of FIG. 6.
Figure 8:
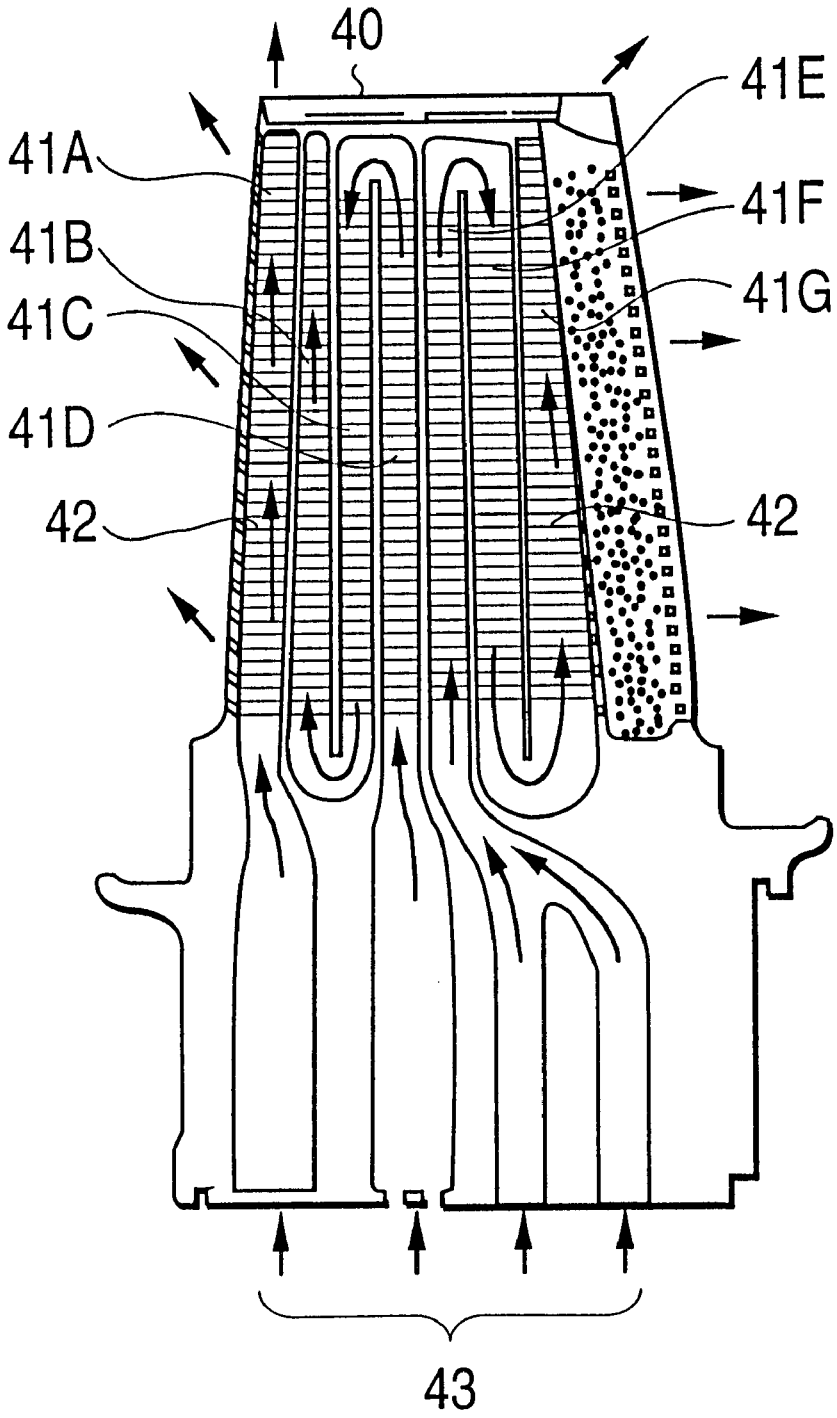
FIG. 8 (PRIOR ART)
FIG. 8 is a longitudinal cross sectional view of another prior art gas turbine moving blade and shows orthogonal turbulators provided therein.

In FIG. 1(*a*), numeral 1 designates a triangular cooling passage and numerals 11, 12 designate orthogonal turbulators provided on both inner wall side faces of the triangular cooling passage 1. As described above in FIG. 5, it is known that ribs arranged orthogonally exhibit the best heat transfer characteristics in a sharp triangle-shaped passage, hence the orthogonal turbulators 11, 12 are arranged in the triangular cooling passage 1, as shown in FIG. 1(*a*).

In FIG. 1(*b*), numeral 2 designates a square cooling passage and numerals 13, 14 designate oblique turbulators provided on both inner wall side faces of the square cooling passage 2. In this square cooling passage, the oblique turbulators 13, 14 are arranged as is known generally.

In FIG. 1(*c*) in which turbulators are arranged in a leading edge portion cooling passage, which is a combination of the arrangements of FIGS. 1(*a*) and (*b*), numeral 21 designates orthogonal turbulators arranged in the rounded tip portion of the leading edge portion cooling passage 3 and numerals 22, 23 designate oblique turbulators arranged to both sides of the smoothly curved inner wall portion in the rear thereof. The orthogonal turbulators 21 correspond to those described in FIG. 1(*a*), that is, the orthogonal turbulators 11, 12 of FIG. 1(*a*) are extended in arcs to connect to each other so as to form the orthogonal turbulators 21 and the oblique turbulators 22, 23 correspond to the oblique turbulators 13, 14 of FIG. 1(*b*).

As shown in FIG. 1(*c*), the orthogonal turbulators 21 and the oblique turbulators 22, 23 are arranged separately from each other and the oblique turbulators 22, 23 extend to a position of line L of terminal ends of the orthogonal turbulators 21 in a mid position of two turbulators of the orthogonal turbulators 21. By employing the cooling passage provided with such separated and complicated turbulators, convection is activated and heat transfer coefficient is enhanced greatly. The gas turbine cooled blade provided with the turbulators so arranged is shown in the cross sectional view of FIG. 2.

Figure 3:
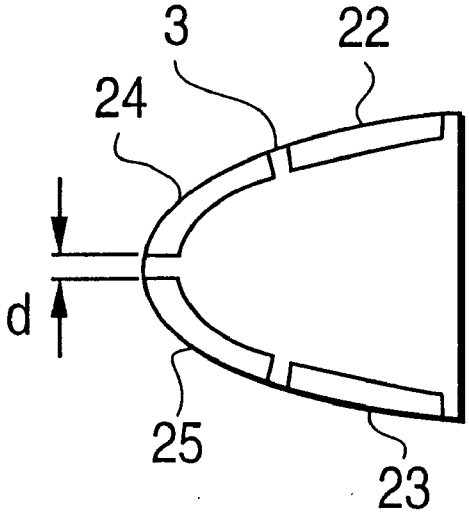
FIG. 3 is a transverse cross sectional view of a leading edge portion cooling passage provided with turbulators of a variation of the embodiment of FIG. 1.

FIG. 3 shows a variation of the turbulators of FIG. 1(*c*), wherein the orthogonal turbulators 21 of FIG. 1(*c*) are divided at a central portion thereof into two portions with a gap d being maintained therebetween. Thus orthogonal turbulators 24, 25 are formed there so that cooling air flows easily through the rounded tip portion of the leading edge portion cooling passage 3 and cooling of this portion is accelerated.

Figure 4:
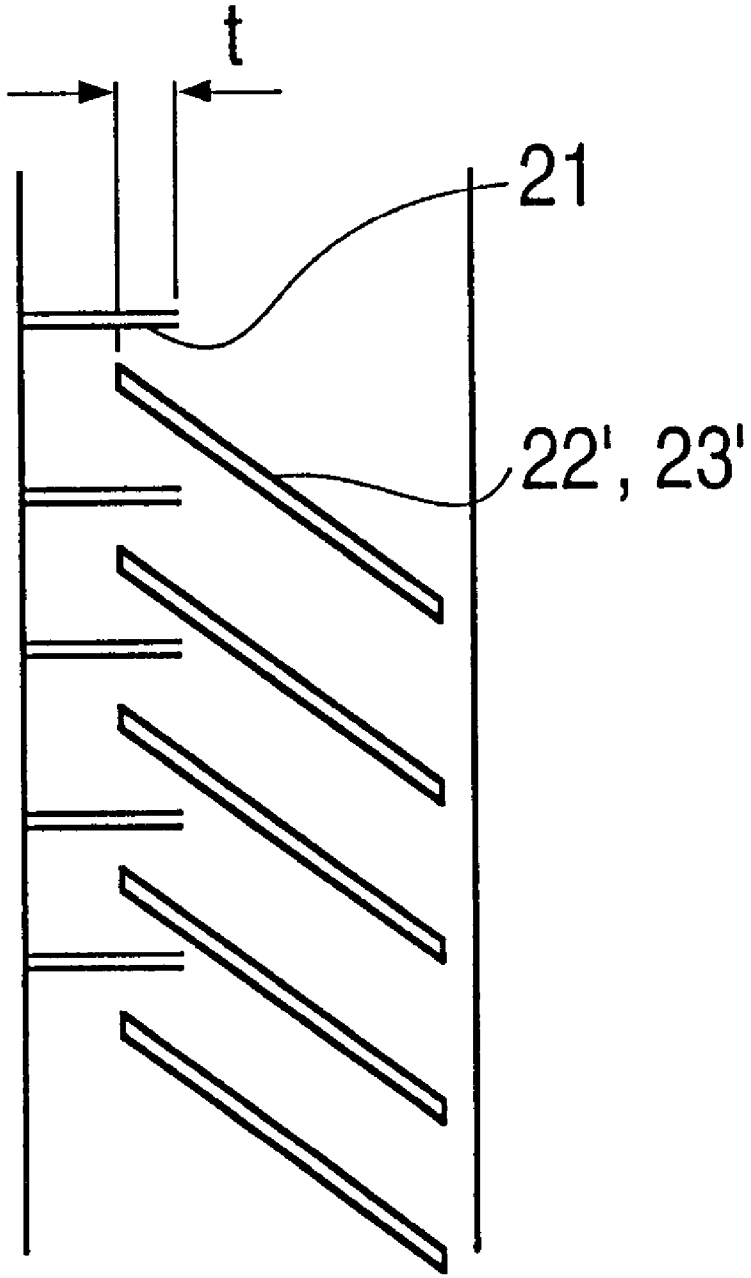
FIG. 4 is a view showing a longitudinal inner wall side face provided with turbulators of another variation of the embodiment of FIG. 1.

FIG. 4 shows another variation example of the turbulators of FIG. 1(*c*), wherein the oblique turbulators 22, 23 shown in FIG. 1(*c*) are extended so that terminal ends of the oblique turbulators 22, 23 come inside between each of the orthogonal turbulators 21 by a length t. Thus, oblique turbulators 22', 23' are formed so that the cooling air passage is made more complicated as compared with that of FIG. 1(*c*), thereby the air flow is made turbulent to be activated and heat transfer effect thereof is enhanced.

It is to be noted that the arrangements of the turbulators in the leading edge portion as described above with respect to FIGS. 1 to 4 are not only for moving blades of a gas turbine but naturally are also applicable to stationary blades.

In the embodiments described above, the orthogonal turbulators 21 or 24, 25 are provided in the rounded portion of the leading edge portion 3 of the gas turbine cooled blade and the oblique turbulators 22, 23 or 22', 23' are provided in the portion in the rear thereof, thereby the cooling performance thereof is enhanced by approximately 10% as compared with the prior art arrangement in which the oblique turbulators only are provided in the leading edge portion.

The present invention provides gas turbine cooled blade turbulators in a leading edge portion cooling passage of a gas turbine cooled blade, characterized in that there are provided orthogonal turbulators in a rounded inner wall portion of a transverse cross sectional tip portion of the leading edge portion cooling passage and oblique turbulators in a smoothly curved inner wall portion in the rear thereof. Hence by use of the orthogonal turbulators and the oblique turbulators, cooling air in the leading edge portion cooling passage is activated and heat transfer performance thereof is enhanced.

What is claimed is:

1. A gas turbine cooled blade comprising:

a leading edge portion having a rounded inner wall portion and smoothly curved opposite inner wall portions extending rearwardly from said rounded inner wall portion, wherein said rounded inner wall portion and said smoothly curved inner wall portions define a single cooling passage;

a plurality of orthogonal turbulators arranged in parallel with one another and provided on said rounded inner wall portion of said cooling passage; and a plurality of oblique turbulators arranged in parallel with one another and provided on said smoothly curved inner wall portions of said cooling passage.

2. A gas turbine cooled blade as claimed in claim 1, wherein each of said orthogonal turbulators are divided into two portions at a central portion of said rounded inner wall portion of said leading edge portion.

3. A gas turbine cooled blade as claimed in claim 1, wherein each of said oblique turbulators is positioned so that a terminal end thereof is located in a space defined between a pair of said orthogonal turbulators disposed adjacent to each other.

* * * * *